US006079477A

United States Patent [19]

Woodhouse

[11] Patent Number: 6,079,477

[45] **Date of Patent: *Jun. 27, 2000**

[54] SEMI-SOLID METAL FORMING PROCESS

[75] Inventor: Gordon H. Woodhouse, St. Catharines, Canada

[73] Assignee: Amcan Castings Limited, Hamilton, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 09/013,023

[22] Filed: Jan. 26, 1998

[51] Int. Cl.[7] ..... B22D 17/00; B22D 25/06; C22F 1/00

[52] U.S. Cl. ..... 164/76.1; 164/113; 164/900; 148/550

[58] Field of Search ..... 164/900, 71.1, 164/76.1, 113; 148/550, 432, 554, 557, 682, 690

[56] References Cited

U.S. PATENT DOCUMENTS

| | | | |
|---|---|---|---|
| 4,415,374 | 11/1983 | Young et al. | 148/2 |
| 5,009,844 | 4/1991 | Laxmanan | 420/548 |
| 5,501,748 | 3/1996 | Gjestland et al. | 148/538 |
| 5,701,942 | 12/1997 | Adachi et al. | 164/71.1 |
| 5,849,115 | 12/1998 | Shiina et al. | 148/549 |

FOREIGN PATENT DOCUMENTS

| | | |
|---|---|---|
| 1199181 | 1/1986 | Canada . |
| 2018456 | 12/1990 | Canada . |
| 2159487 | 10/1994 | Canada . |
| 2009722 | 11/1995 | Canada . |
| 0 841 406 A1 | 7/1997 | European Pat. Off. . |
| 0 903 193 A1 | 11/1997 | European Pat. Off. . |

OTHER PUBLICATIONS

Mashy–State Extrusion, Rolling and Forging—by: M. Kiuchi, Prof., Dr.–Ing./S.Sugiyama, Assistant Researcher.

Semi–Solid Forming of Aluminum and Magnesium by A.I. "Ed" Nussbaum, Contributing Editor, in Light Metal Age, Jun. 1996.

Semi–Solid Forming Using Strain–Introduced Mg–Al Based Alloys by S. Kamado and Y. Komima of Department of Mechanical Engineering, Nagaoka University of Technology, Nagaoka, Japan.

Brochures entitled "Velvetflow" by Ormet.

*Primary Examiner*—Kuang Y. Lin

*Attorney, Agent, or Firm*—Gowling, Strathy & Henderson

[57] ABSTRACT

A semi-solid metal forming process using a cast billet and having the following steps: 1. heating the cast billet to a temperature above its recrystallization temperature and below its solidus temperature; 2. extruding the cast billet into an extruded column; 3. cutting the extruded column into at least one billet; 4. heating the billet from step 3 to a semi-solid state; and 5. squeezing the billet from step 4 into a cavity in a metal forming die set to form a part.

17 Claims, 21 Drawing Sheets

SEMI-SOLID METAL FORMING PROCESS

FIELD OF THE INVENTION

This invention relates generally to semi-solid metal forming and more particularly to the formation and use of magnesium billets in semi-solid metal die casting and semi-solid forging processes.

BACKGROUND

Metal die casting is a process in which molten metal is caused to flow into a cavity defined by a mold. In conventional metal die casting, molten metal is injected into the cavity. In semi-solid metal die casting processes, a metal billet is pre-heated to a point of softening, to a temperature above the solidus and below the liquidus to produce a partially solid, partially liquid consistency prior to placing the billet or "slug" in a shot sleeve in the casting machine.

Semi-solid metal die casting enables control of the microstructure of the finished part to a degree which produces a stronger part than is possible with conventional molten metal die-casting processes. As compared with conventional metal die-casting processes, semi-solid metal casting produces parts of improved casting quality in that they exhibit lower porosity, parts shrink less upon cooling enabling closer tolerances and physical properties are better. In addition, semi-solid metal casting has a reduced cycle time and the lower temperatures utilized result in decreased die wear. Because of the absence of molten metal there is less pollution and safety hazards are reduced.

In semi-solid metal die casting, a billet is first formed which is treated to form fine grained equiaxed crystals as opposed to a dentritic structure. Subsequent heating, forming and solidification of a formed part using a treated billet avoids the formation of a dentritic structure in the finished part.

To work successfully in semi-solid metal casting, the grain structure of a billet must exhibit the necessary degree of lubricity and viscosity to give good laminar flow in the die cavity. For example an untreated DC cast billet will shear along its dentritic axis rather than flow hence the need for fine grained equiaxed crystals.

Flowability is further affected by grain size and solid/liquid ratio. In addition forming parameters such as die temperatures and gate velocity will affect the casting process. Accordingly, all of the foregoing parameters have to be optimized in order to produce successful parts.

Metal forging is another process in which metal is caused to flow into a cavity defined by a mold. Unlike die casting, metal is not injected as a liquid into the cavity, but rather a solid billet or slug is placed between dies which are subsequently forced together to squeeze the billet or slug into the cavity as the die is closed. In semi-solid metal forging, the metal billet is pre-heated to a partially solid, partially liquid consistency prior to forging. The consistency is similar to that used for semi-solid metal die casting.

As in semi-solid metal die casting, the billet should consist of fine grained equiaxed crystals rather than a dendritic structure to optimize the flow of metal between the dies and to optimize the physical characteristics of the finished parts.

An earlier process for forming a treated billet involves the use of magnetic stirring during the cooling of a cast billet to break up and avoid the formation of a dentritic structure. Magnetic stirring is however a relatively slow and expensive process.

U.S. Pat. No. 4,415,374 (Young et al) describes an alternate process for forming a billet of aluminum for use in a semi-solid metal die casting process. Young et al describes a process having the following steps:

1. Melting and casting an ingot;
2. Cooling the ingot to room temperature;
3. Reheating the ingot above its recrystallization temperature but below its solidus temperature;
4. Extruding the ingot;
5. Cooling the ingot to room temperature;
6. Cold working the ingot;
7. Reheating the ingot above its solidus temperature; and
8. Forming and quenching the ingot.

The ingot produced according to the process described in Young may then be subsequently heated to semi-solid casting temperature and formed into a part in a die casting process.

Even though Young avoids the requirement for magnetic stirring, it is nevertheless a cumbersome process including a large number of process steps.

More recently a process has been proposed in which a cast ingot is machined down to a billet of approximately one inch in diameter and deformed by subjection to a compressive force. The deformed billet is then heated to a temperature above its recrystallization temperature and below its solidus temperature. The billet is then cooled to room temperature for subsequent re-heating and use in a semi-solid metal casting process. This process however involves an expensive and wasteful machining operation and only appears to work with relatively small billet diameters of less than about one inch (approximately 25 mm) diameter.

It is therefore an object of the present invention to provide a process for semi-solid metal die casting which avoids not only magnetic stirring, but also eliminates many of the steps that would be required pursuant to the Young process.

It is a further object of the present invention to provide a semi-solid metal die casting process which avoids the machining cold working heating, cooling and re-heating steps associated with other processes.

It is yet a further object of the present invention to provide a process capable of forming billets for use in semi-solid metal die casting processes that may be significantly greater than about one inch (approximately 25 mm) in diameter.

SUMMARY OF THE INVENTION

A semi-solid metal die casting process using a direct chill cast billet and consisting of the following steps:

i) heating the direct chill cast billet to a temperature above its recrystallization temperature and below its solidus temperature;

ii) reducing the diameter of the heated billed from step i) and breaking down its grain structure by extruding it through an extruding die at said temperature above its recrystallization temperature and below its solidus temperature to form an extruded column without introducing any strain in addition to that associated with the extruding;

iii) cutting the extruded column into billets;

iv) heating a billet from step iii) to a thixotropic forming temperature; and, v) squeezing the heated billet from step iv) between the dies of a metal forming die set to form a part.

wherein the direct chill cast billet used in step (i) during its production was cooled at a rate sufficient to produce a grain size of less than 100 microns.

DESCRIPTION OF DRAWINGS

Preferred embodiments of the present invention are described below with reference to the accompanying drawings in which.

DESCRIPTION OF PREFERRED EMBODIMENTS

Figure 1A:
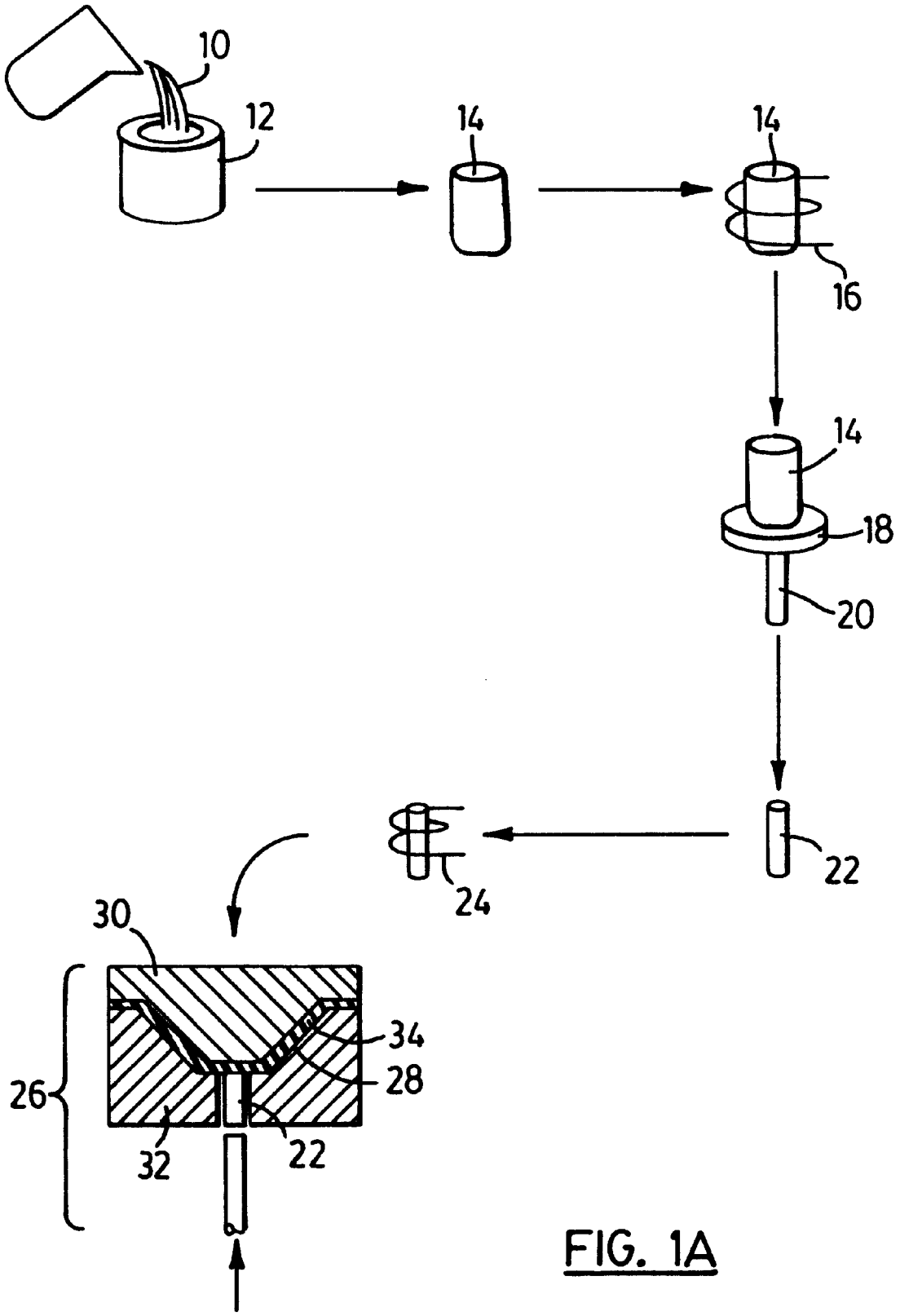
FIG. 1A is a schematic representation of the process of the present invention.
Figure 1B:
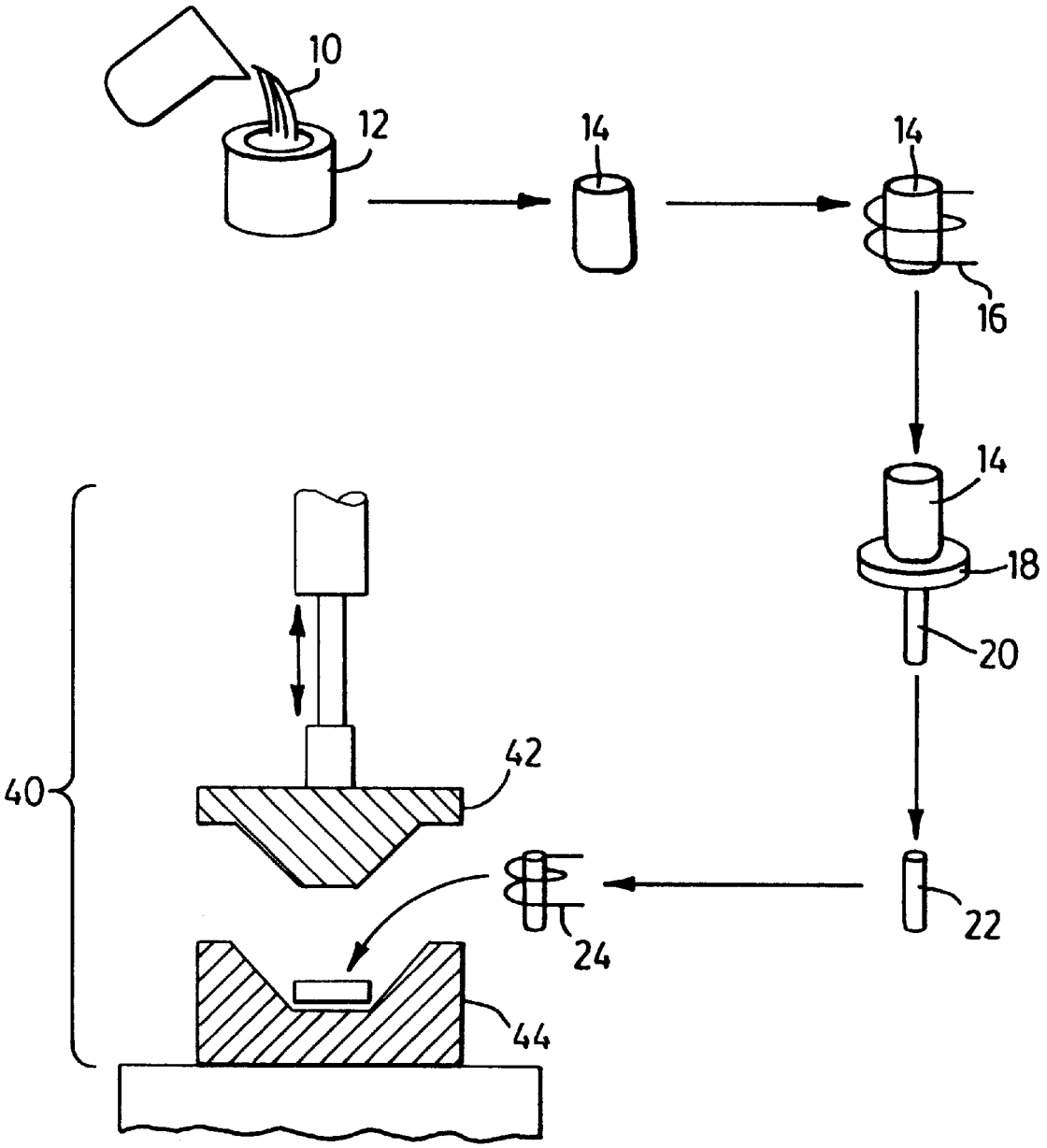
FIG. 1B is a schematic representation of an alternate embodiment process according to the present invention.

Referring to FIG. 1, molten metal 10 is poured from a ladle into a mold 12 and allowed to solidify into a cast billet 14. The cast billet 14 is heated, for example by inductive heating coil 16 to a temperature above its recrystallization temperature and below its solidus temperature.

The heated cast billet 14 is then extruded through an extruding die 18 to form an extruded column 20. The extruded column 20 is cut to a suitable length billet 22 for use in a semi-solid metal die casting process.

The billet 22 is heated to a forming temperature corresponding to a semi-solid state ie. a "thixotropic forming temperature", for example by induction coils 24, and transferred to a die casting apparatus 26. The heated billet 22 is squeezed by the die casting apparatus into a cavity 28 between mold parts 30 and 32 to form a part 34 conforming in shape to that of the cavity 28.

Alternatively, the heated billet 22 may be transferred to a forging apparatus 40 where it is squeezed into a cavity defined between a movable die 42 and a fixed die 44.

The present invention is further illustrated by the examples set out below.

EXAMPLE 1

The microstructure of two AZ61 alloy, 3 in. diameter by 7 in. length extruded billets in the as extruded and solution heat treated condition were examined.

The billets were produced initially as an 8 ½ in. direct chill cast billet. The billets were cooled at a high chill rate utilizing copper molds and a water spray to provide a chill rate of at least 2° C. per second at the billet centre. The billets were cut into 2 ft. long sections and the diameter machined down to 8 in. to remove imperfections to the outside edge.

Grain sizing of the 8 inch billet perpendicular to the extrusion axis was 38 microns at the outside, 48 microns at the half radius and 48 microns at the center. As expected, the grain size in the longitudinal or extrusion direction was somewhat larger being approximately 51 microns at the outside, 64 microns at the half radius and 74 microns at the center.

The billets were then heated in 4–6 minute intervals in three induction furnaces. The furnaces heated the billets to 100° C., 200° C., 300° C. (total heating time approximately 15 minutes.) The billet was then placed in the extrusion chamber, which was at 380° C. and the billet was extruded at between 330° C. and 350° C., in one stage down to a 3 in. diameter extrusion billet. The first 14 ft. of extrusion and the last few feet were discarded. The remainder of the extrusion was cut into 7 in. sections or "slugs".

PROCEDURE

Two of the sections of the extrusion billet referred to as billet 1 and billet 2, in AZ61 alloy were examined in the "as extruded" condition by sectioning a 0.5 in. section off the end of each billet, (billets were randomly selected.) A photomicrograph was taken perpendicular to the axis of the billet from the centre and from the outside edge. The photomicrographs were polished and etched using 2% nitol etchant. The photomicrographs were examined at various magnifications to observe grain structure. A photomicrograph was taken at each magnification and the grain size estimated.

The two extrusion billet sections were then given the following solution heat treatment to recrystallize the grain structure;

| SOLUTION HEAT TREATMENT | |
|---|---|
| Ramp 150° C.–338° C. | 3.0 hrs |
| Hold 338° C. | 0.1 hrs |
| Ramp 338° C.–413° C. | 1.5 hrs |
| Hold 413° C. | 0.5 hrs |
| Ramp 413° C.–426° C. | 0.5 hrs |
| Hold 426° C. | 12.0 hrs |
| Air Cool | |
| (Furnace atmosphere 10% $CO_2$ to avoid ignition.; | |

The same procedure was followed in billet sectioning polishing and etching as previously described with the "as extruded" billet sections.

From the same samples photomicropraghs were made at the centre of each billet parallel to the extrusion axis. These micros were taken from the as extruded and the solution heat treated billets. Photo micrographs were made at from 100× to 400× magnification of these samples.

The purpose for solution heat treating the extrusion billets and analyzing the samples was to determine the effect on grain size and shape resulting from heating and extruding the DC cast billet. The solution heat treating was not carried out under the optimum circumstances as equipment availability necessitated the use of convection heating rather than induction heating. Preferably the heating cycle should not exceed 20 minutes and accordingly multi-state induction heating would be preferable over convection heating. Nevertheless the results were quite favourable as set out below.

RESULTS

Figure 2:
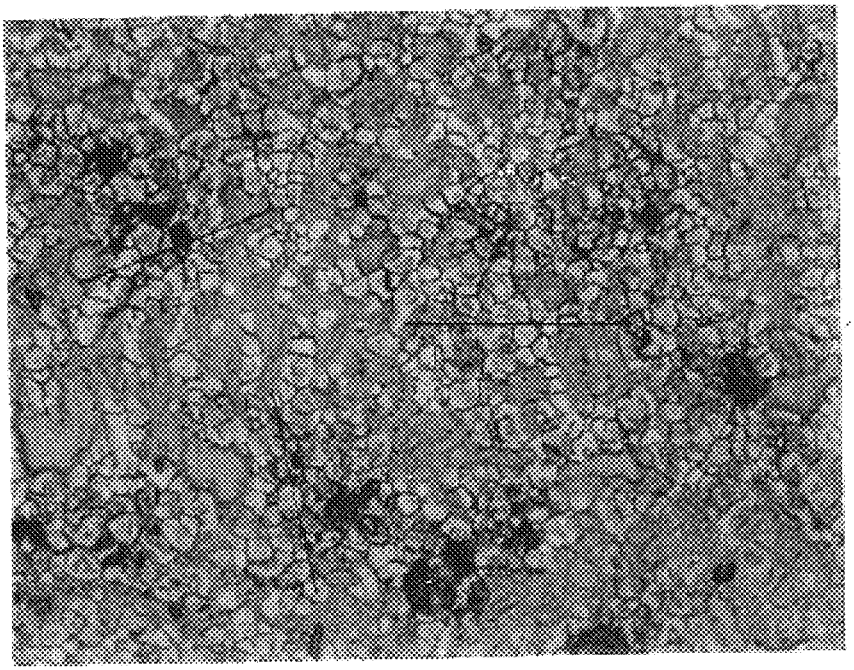
FIGS. 2 through 30 are photomicrographs of billets cut from extruded cast billets and are individually described in Example 1 below.

The photomicrographs which are set out in FIGS. 2 through 30 below were taken are as follows:

FIG. 2 is a photomicrograph of the outside edge of billet 1, as extruded, at 200× magnification.

Figure 3:
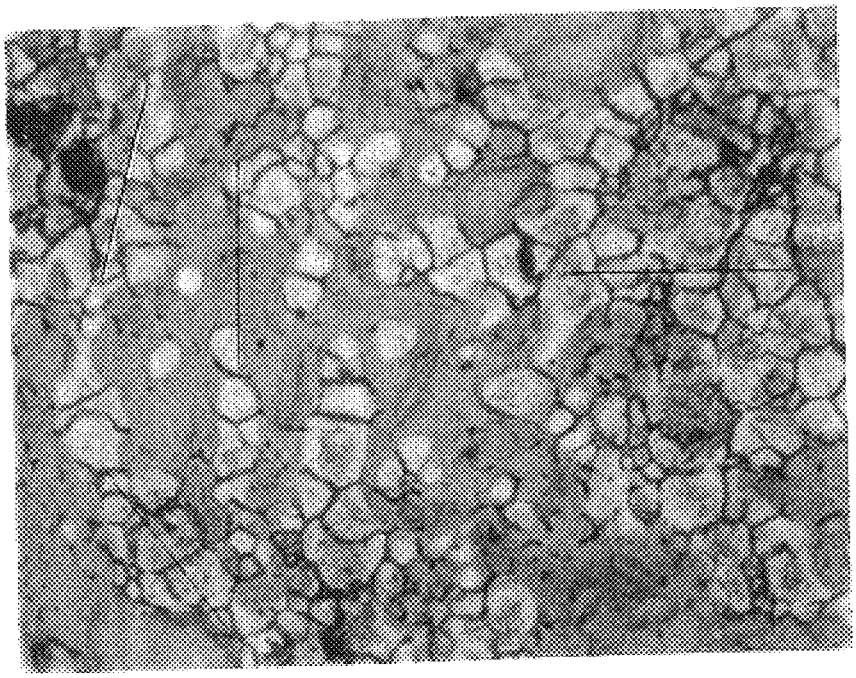
Figure 4:
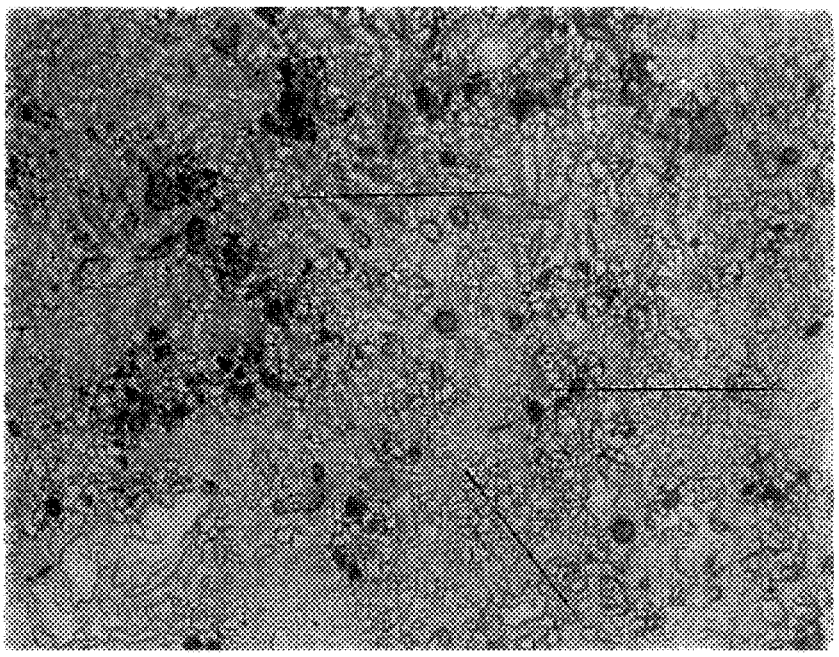
Figure 5:
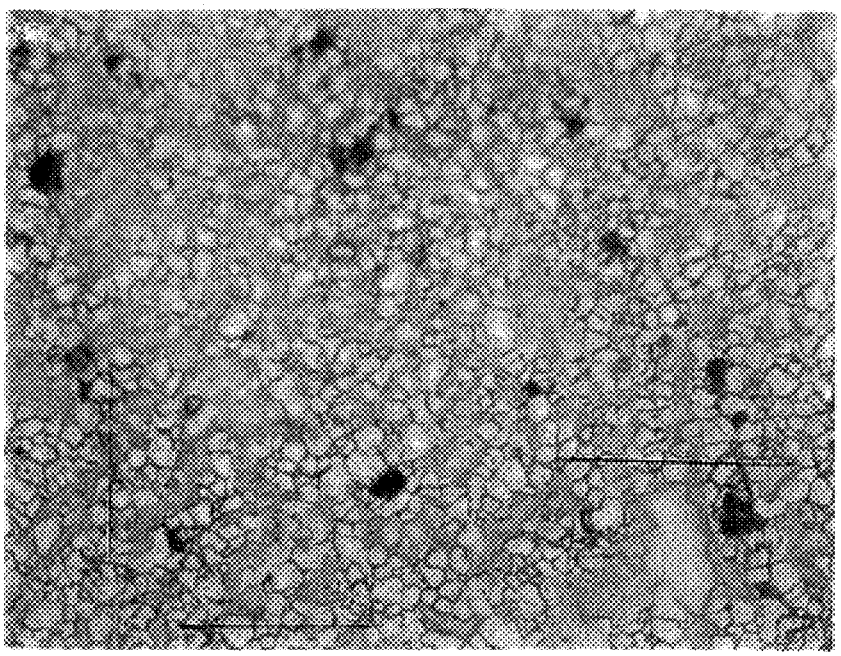
Figure 6:
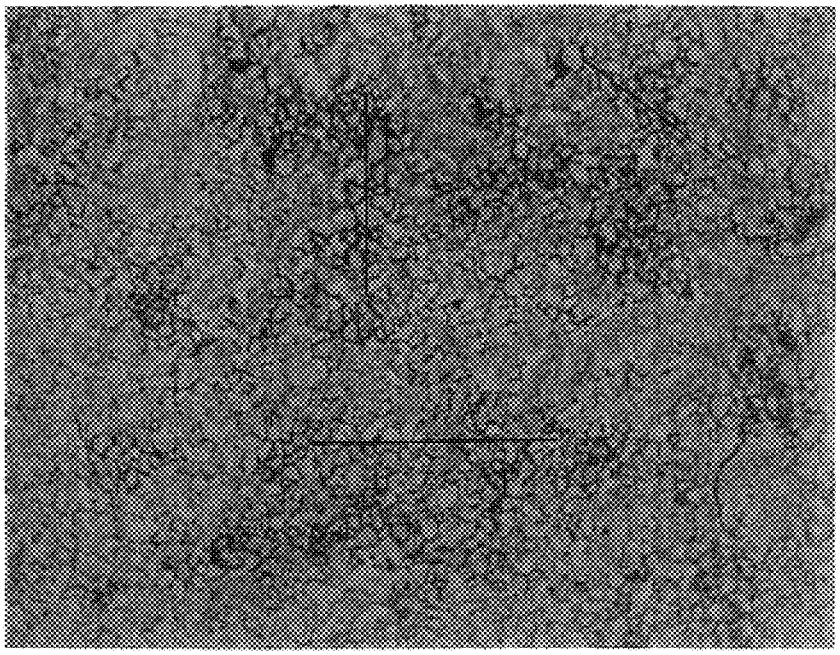
Figure 7:
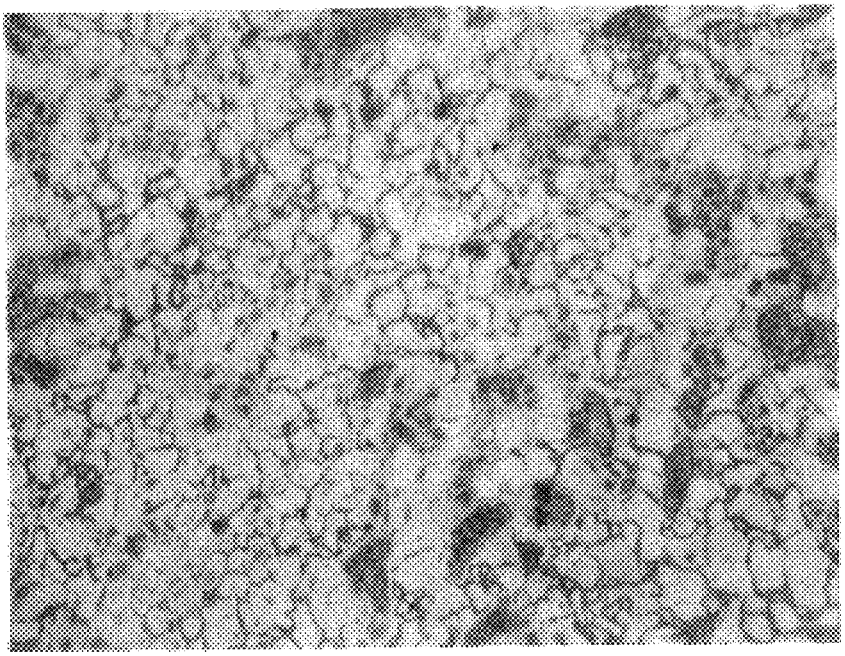
Figure 8:
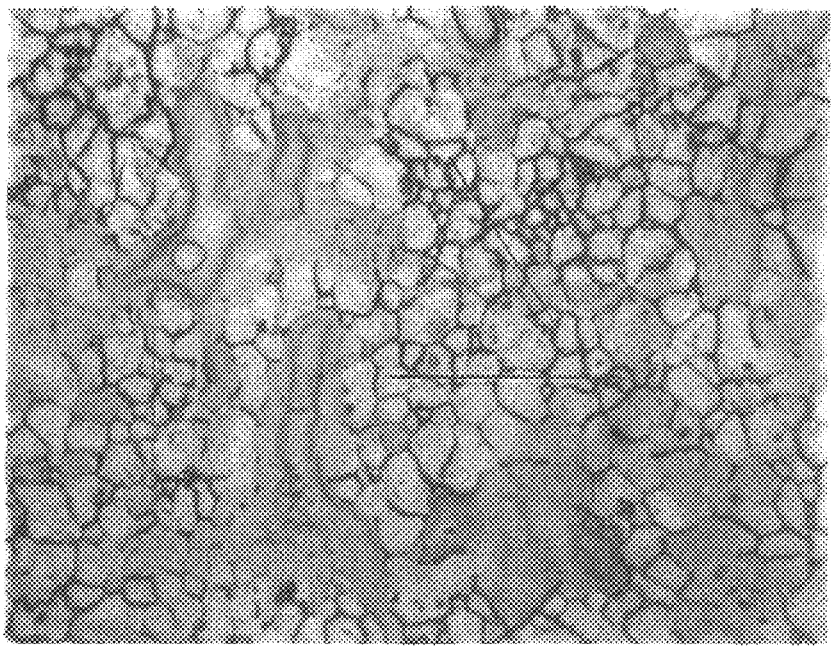
Figure 9:
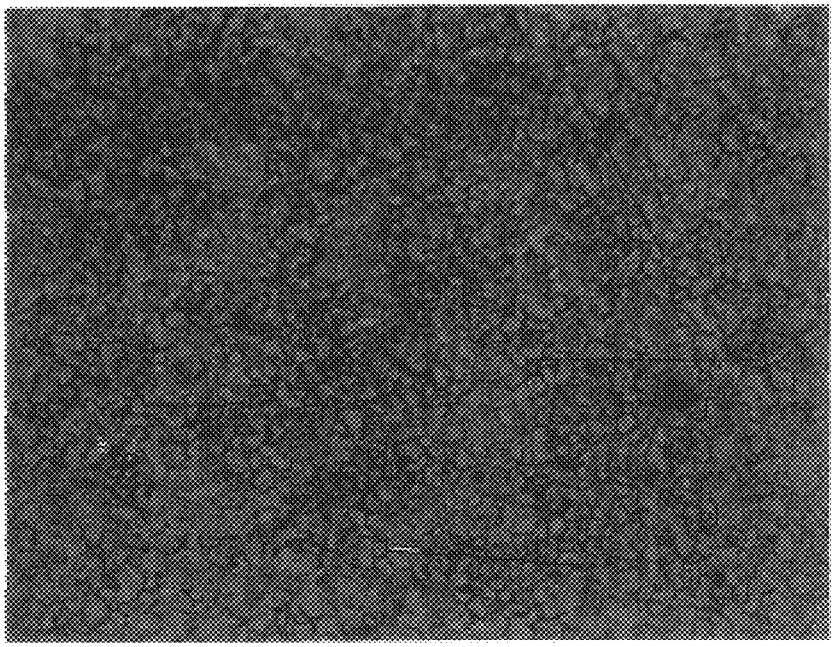
Figure 10:
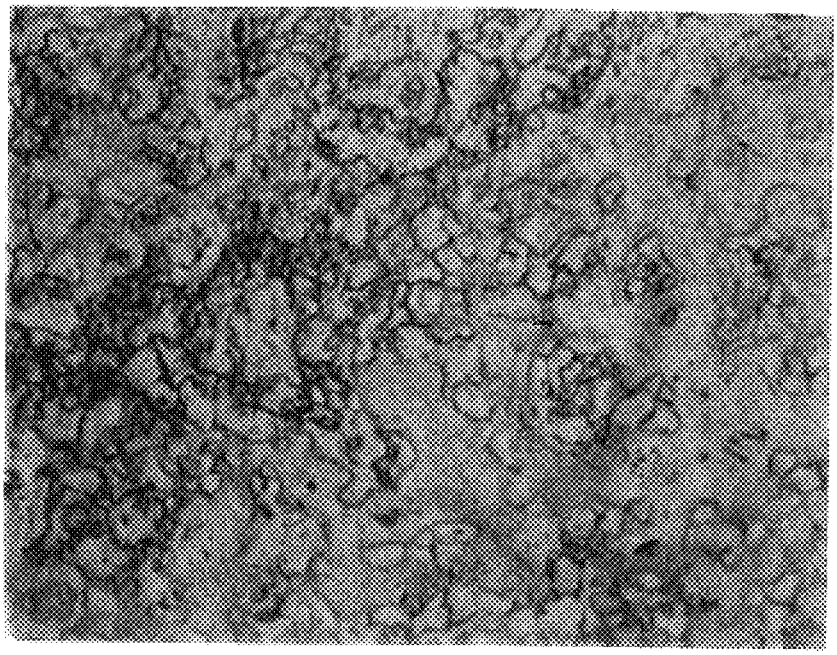
Figure 11:
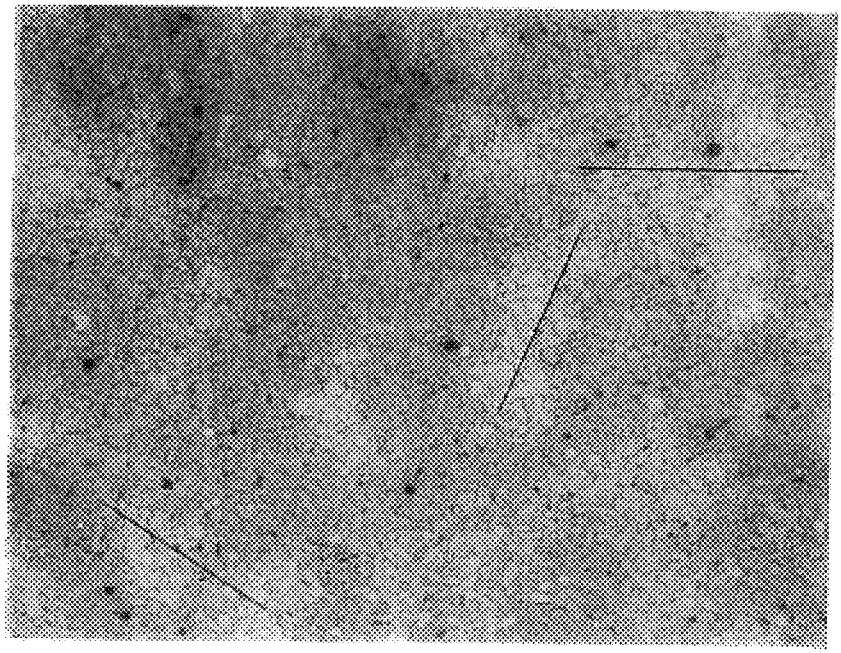
Figure 12:
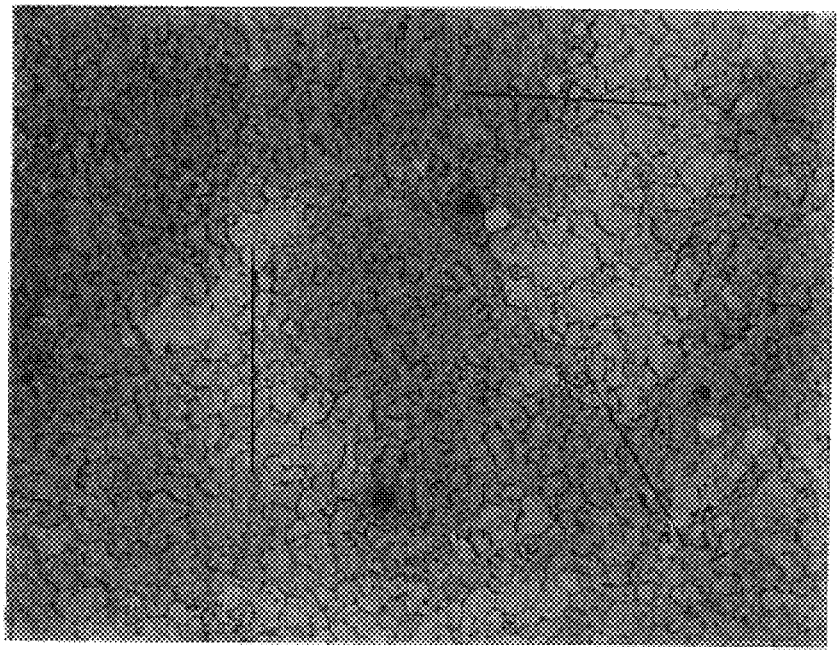
Figure 13:
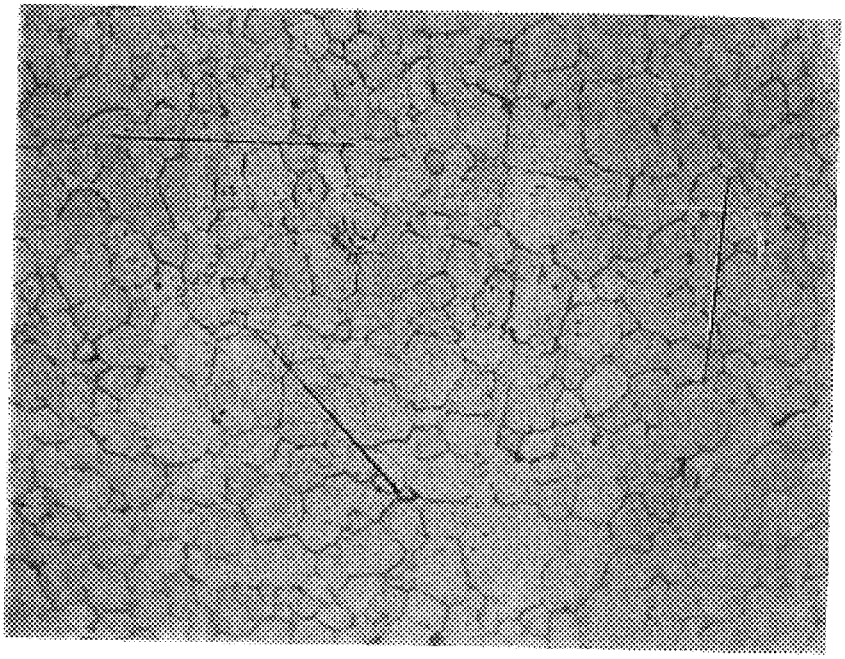
Figure 14:
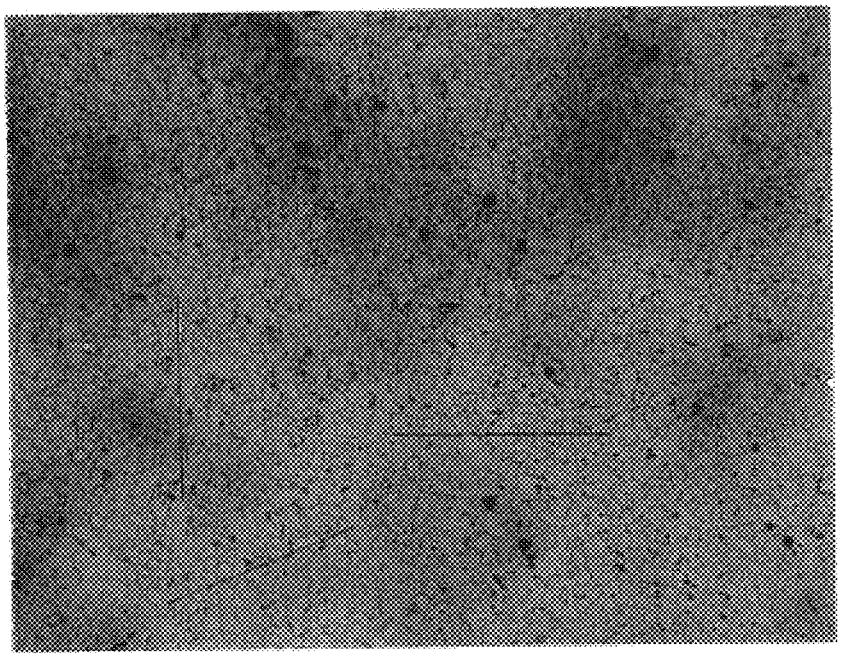
Figure 15:
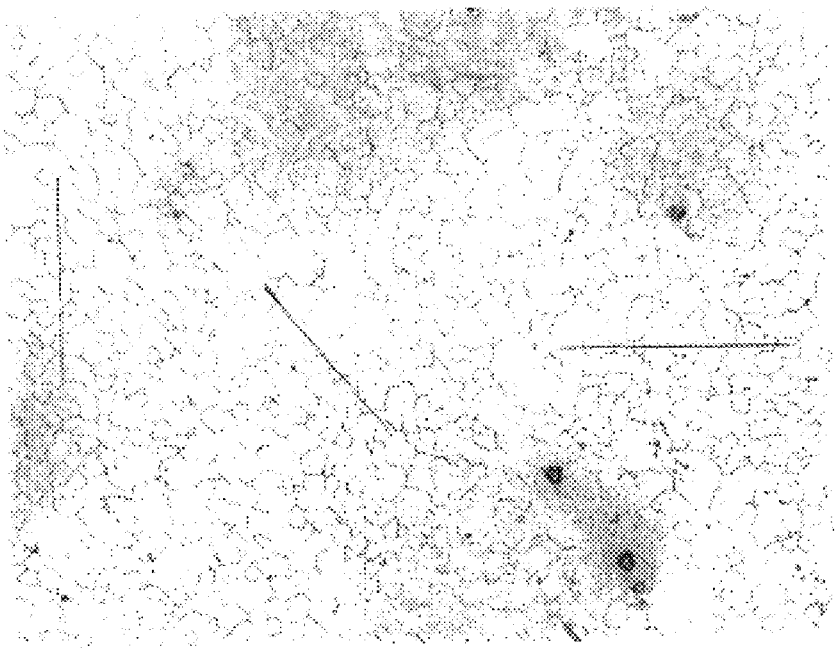
Figure 16:
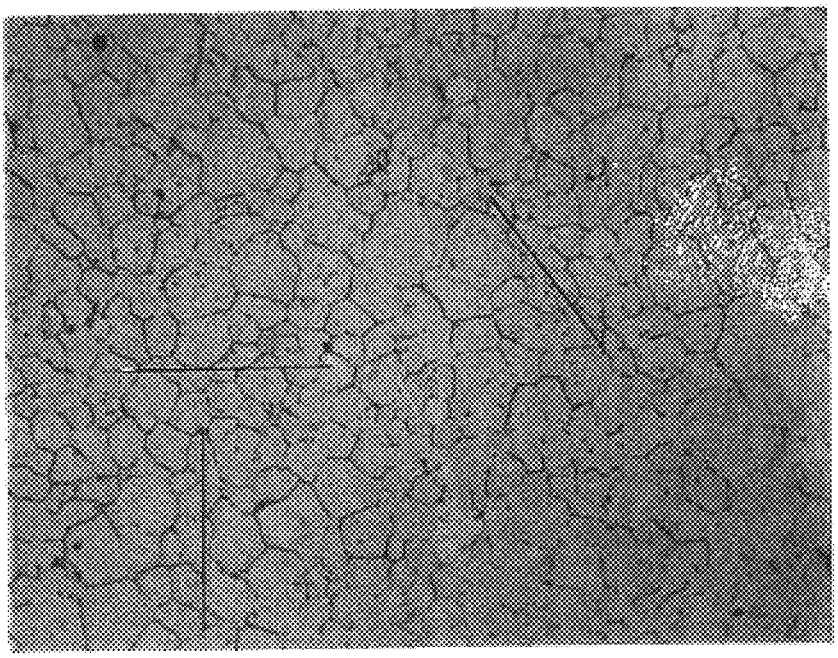
Figure 17:
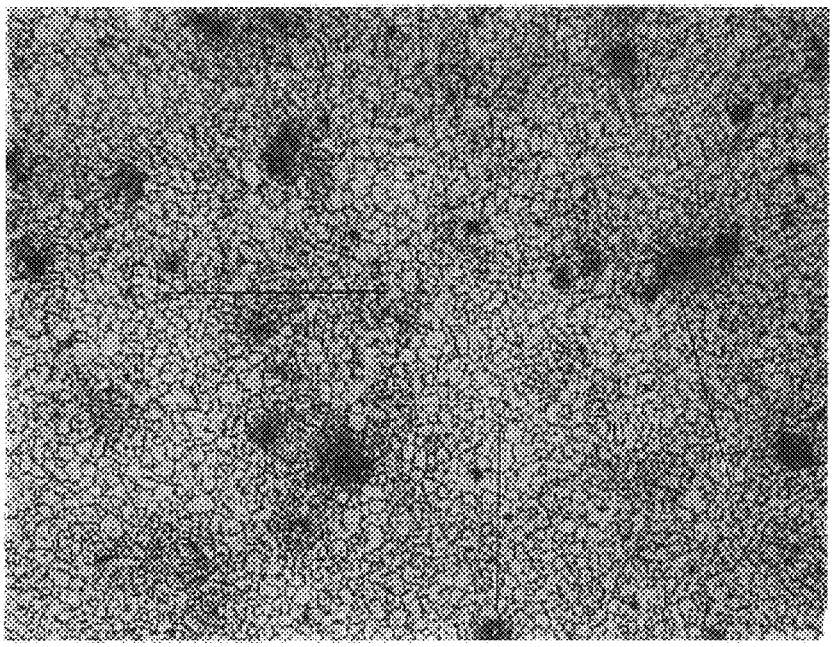
Figure 18:
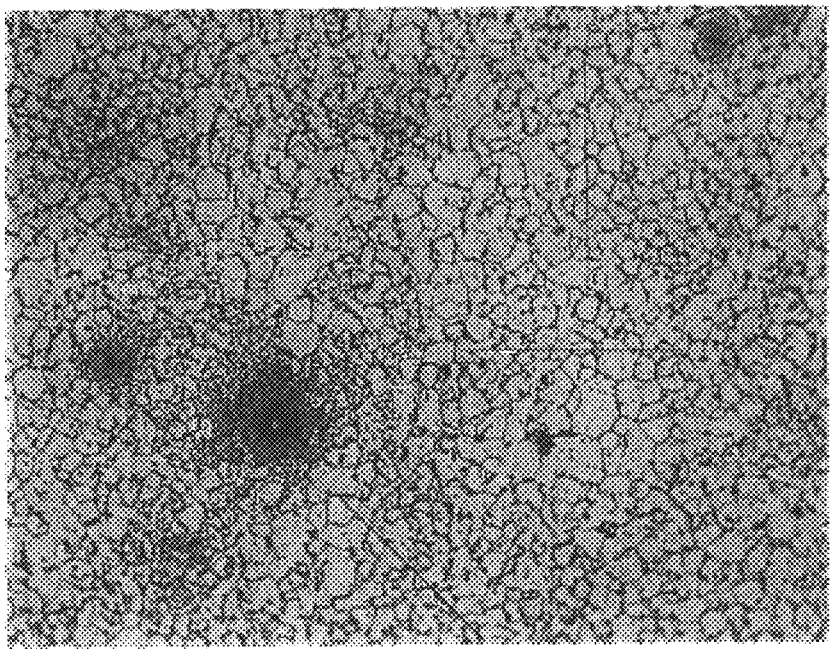
Figure 19:
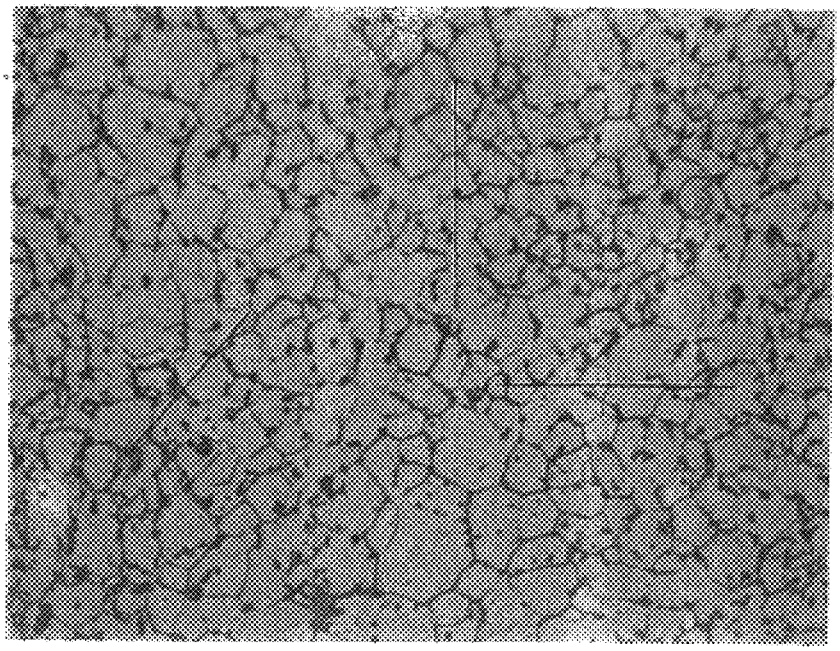
Figure 20:
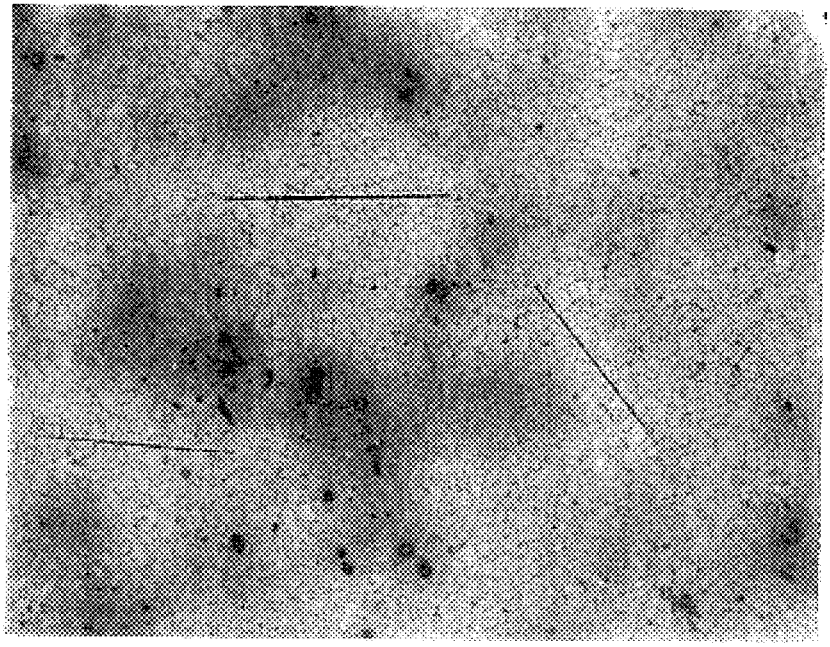
Figure 21:
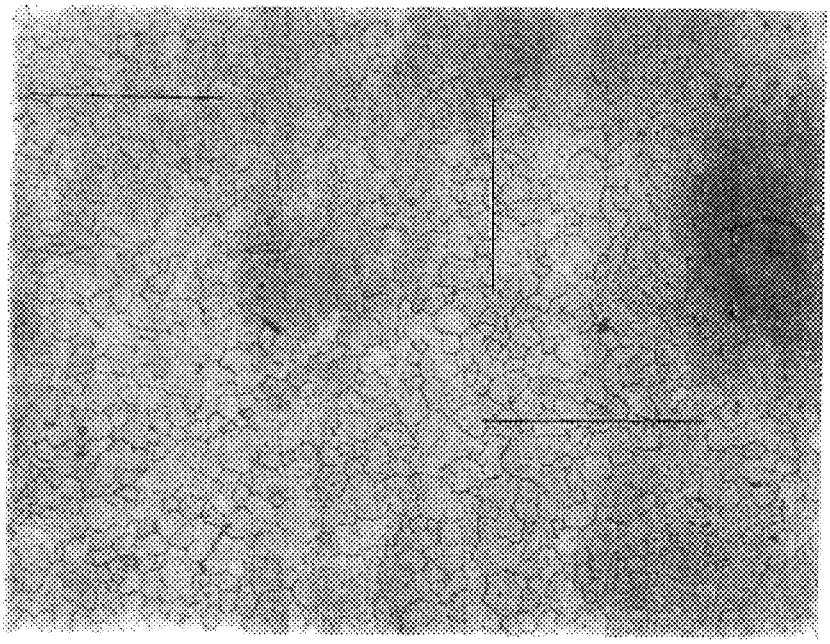
Figure 22:
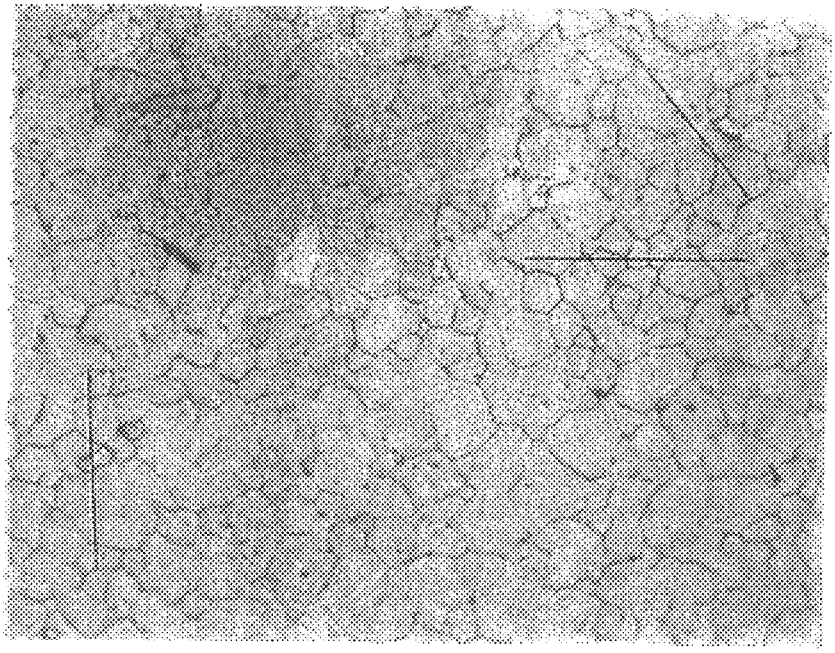
Figure 23:
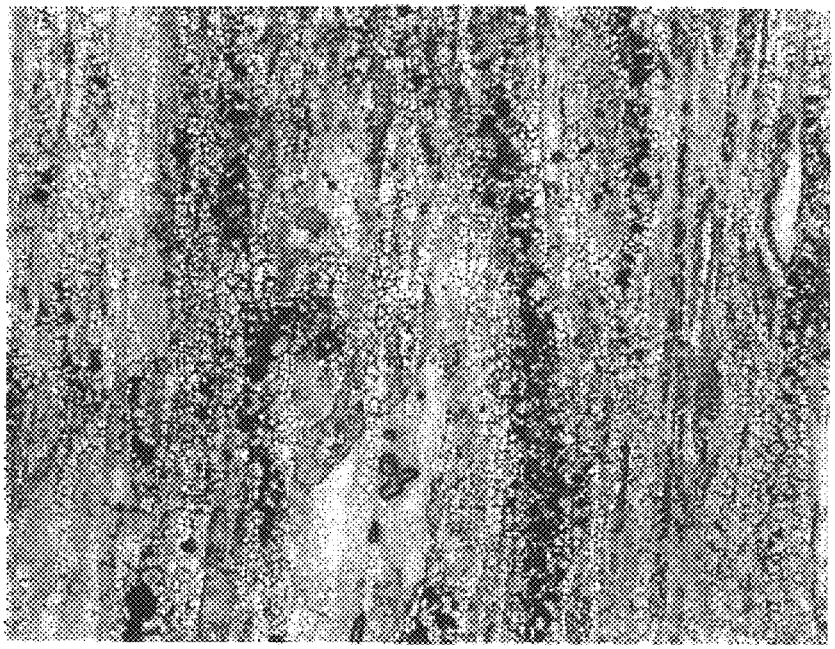
Figure 24:
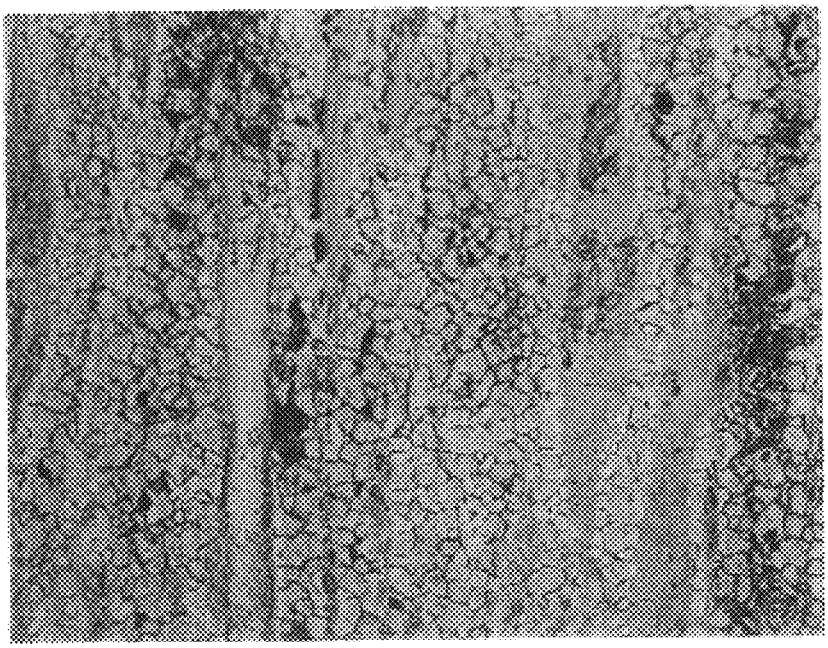
Figure 25:
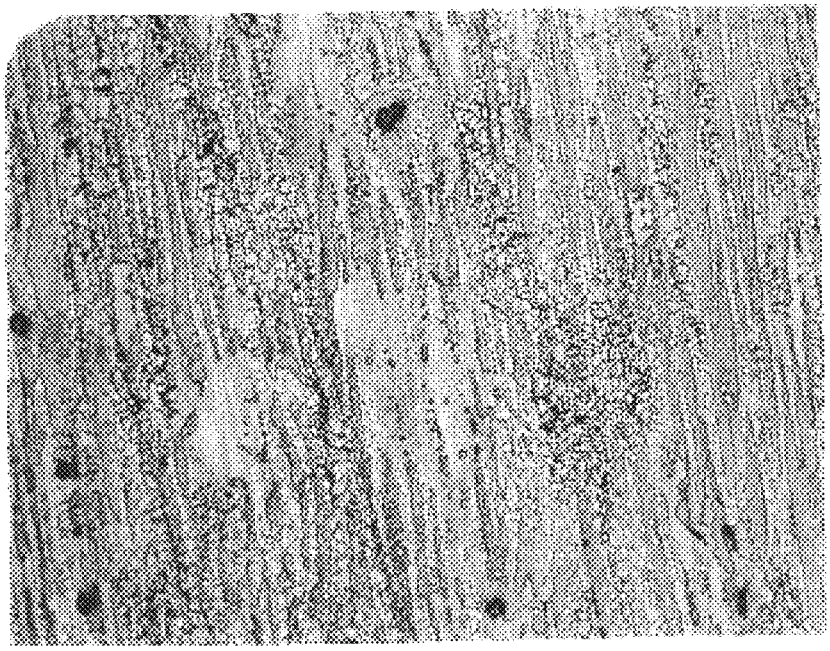
Figure 26:
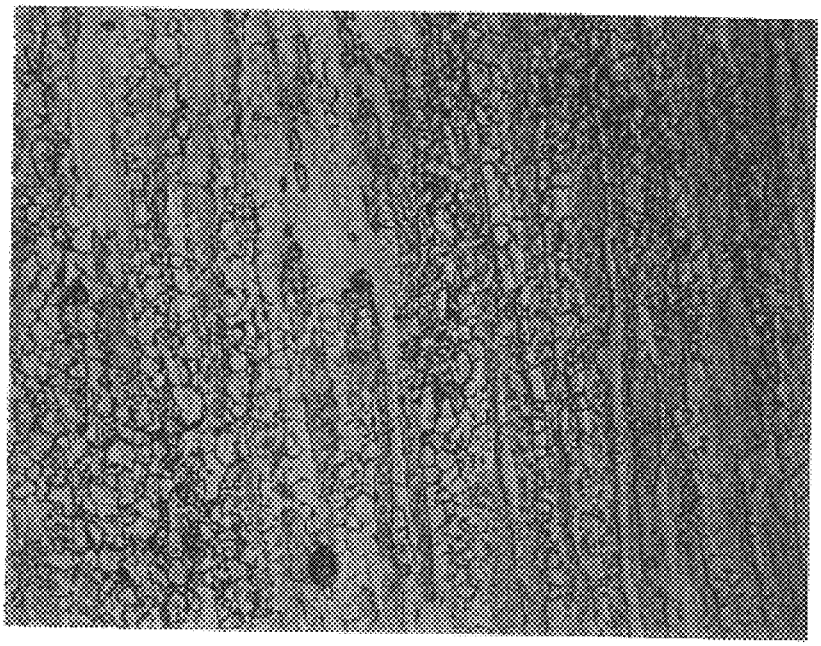
Figure 27:
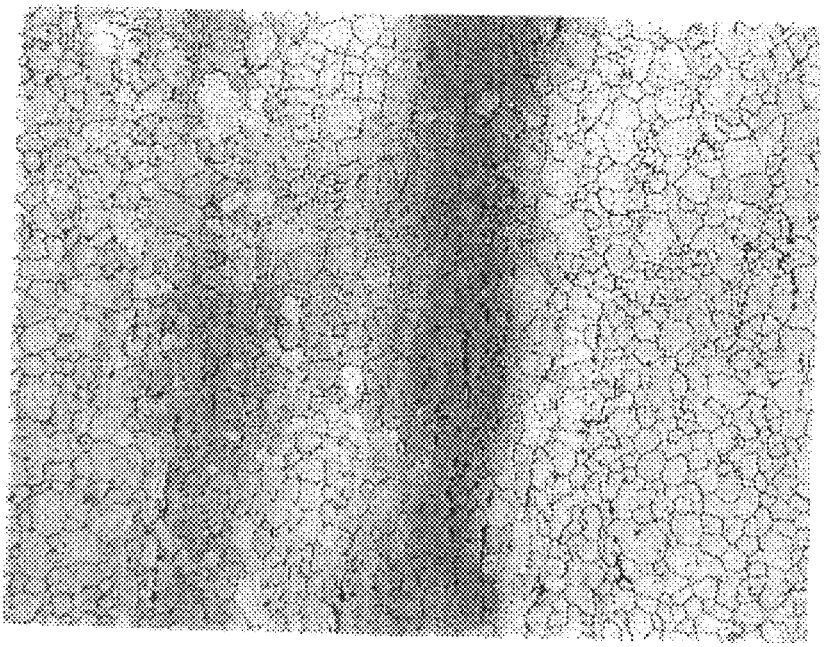
Figure 28:
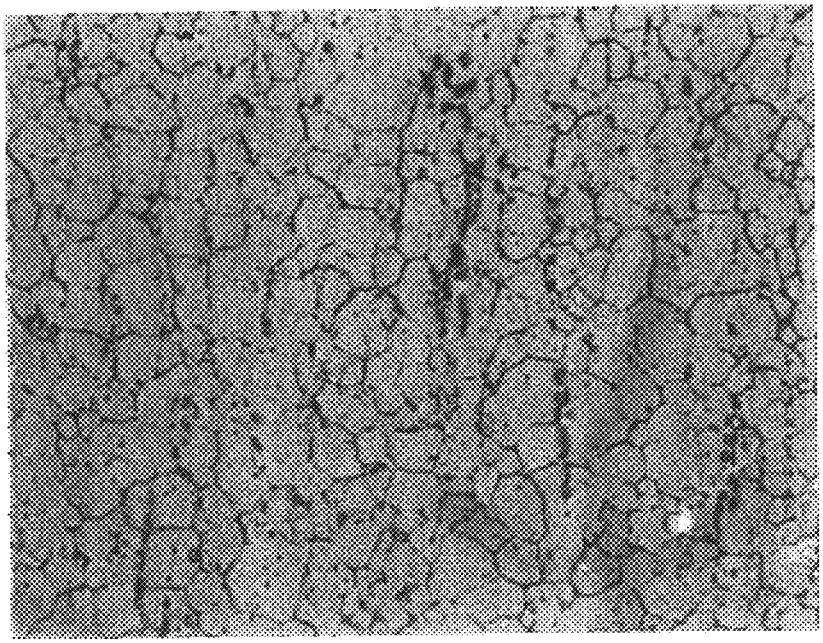
Figure 29:
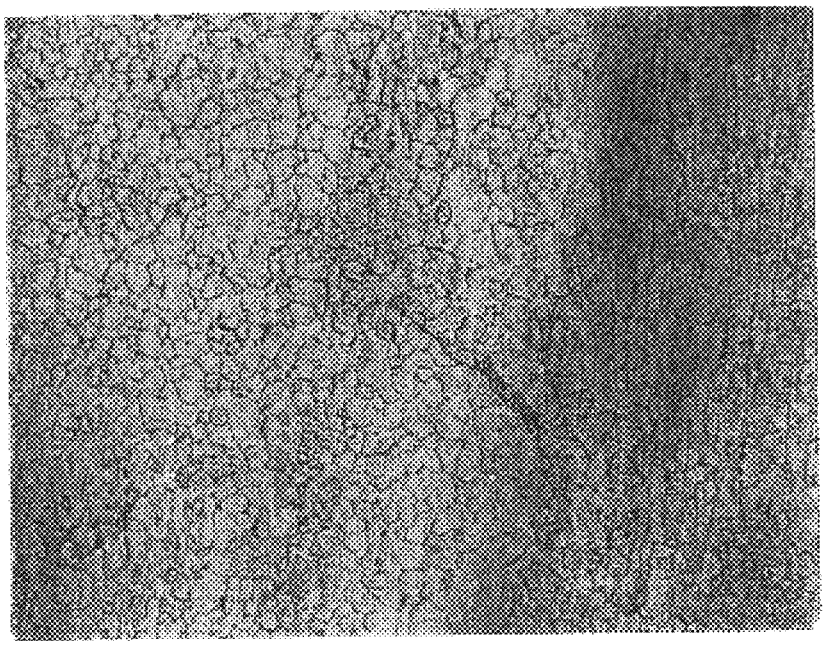
Figure 30:
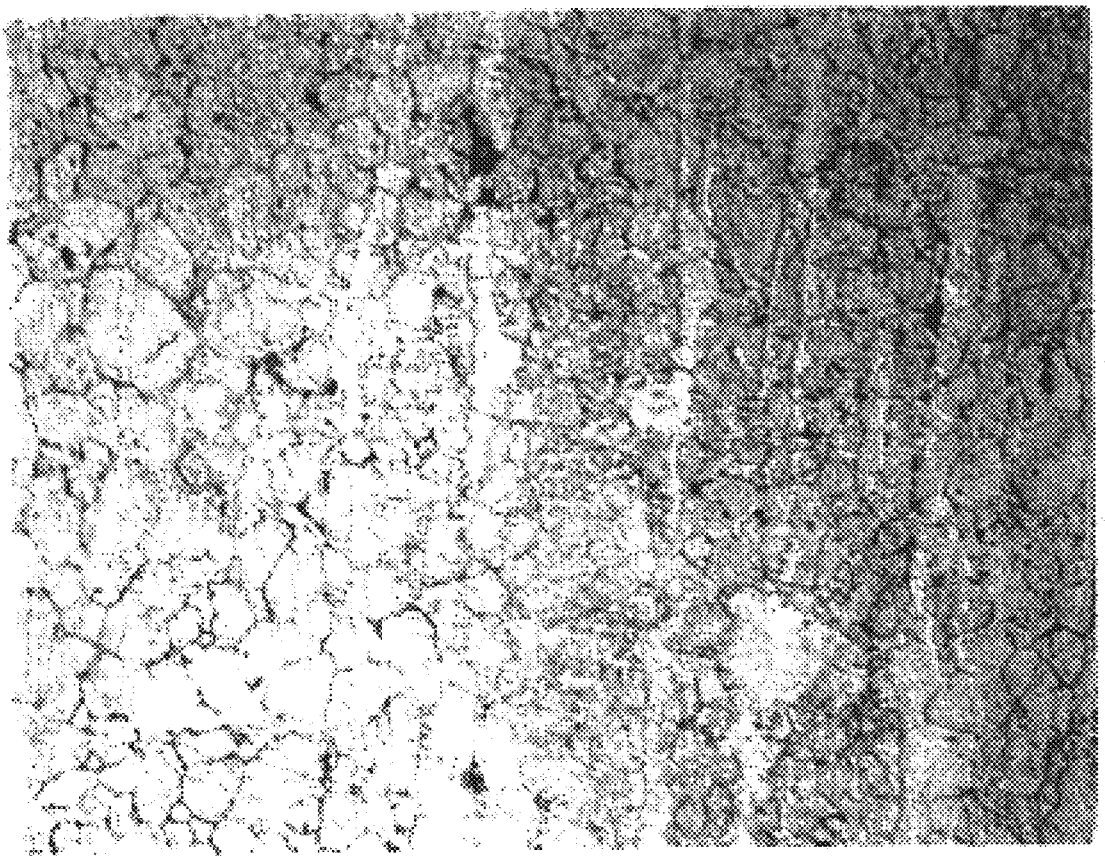

FIG. 3 is a photomicrograph of the outside edge of billet 1, as extruded at 400× magnification;

FIG. 4 is a photomicrograph of the centre of billet 1, as extruded under 100× magnification;

FIG. 5 is a photomicrograph of the centre of billet 1, as extruded under 200× magnification;

FIG. 6 is a photomicrograph of the outside edge of billet 2, as extruded, at 200× magnification;

FIG. 7 is a photomicrograph of the outside edge of billet 2, as extruded, at 400× magnification;

FIG. 8 is a photomicrograph of the centre of billet 1, as extruded, at 400× magnification;

FIG. 9 is a photomicrograph of the centre of billet 2, as extruded, at 200× magnification;

FIG. 10 is a photomicrograph of the centre of billet 2, as extruded, at 400× magnification;

FIG. 11 is a photomicrograph of the outside edge of billet 1, extruded and solution heat treated, at 50× magnification;

FIG. 12 is a photomicrograph of the outside edge of billet 1, extruded and solution heat treated, at 100× magnification;

FIG. 13 is a photomicrograph of the outside edge of billet 1, extruded and solution heat treated, at 200× magnification;

FIG. 14 is a photomicrograph of the centre of billet 1, extruded and solution heat treated at 50× magnification;

FIG. 15 is a photomicrograph of the centre of billet 1, extruded and solution heat treated at 100× magnification;

FIG. 16 is a photomicrograph of the centre of billet 1, extruded and solution heat treated, at 200× magnification;

FIG. 17 is a photomicrograph of the outside edge of billet 2, extruded and solution heat treated, at 50× magnification;

FIG. 18 is a photomicrograph of the outside edge of billet 2, extruded and solution heat treated, at 100× magnification;

FIG. 19 is a photomicrograph of the outside edge of billet 2, extruded and solution heat treated, at 200× magnification;

FIG. 20 is a photomicrograph of the centre of billet 2, extruded and solution heat treated, at 50× magnification;

FIG. 21 is a photomicrograph of the centre of billet 2, extruded and solution heat treated, at 100× magnification;

FIG. 22 is a photomicrograph of the centre of billet 2, extruded and solution heat treated, at 200× magnification;

FIG. 23 is a photomicrograph of the centre of billet 1, as extruded, parallel to the extrusion axis, at 100× magnification;

FIG. 24 is a photomicrograph of the centre of billet 1, as extruded, parallel to the extrusion axis, at 200× magnification;

FIG. 25 is a photomicrograph of the centre of billet 2, as extruded, parallel to the extrusion axis, at 100× magnification;

FIG. 26 is a photomicrograph of the centre of billet 2, as extruded, parallel to the extrusion axis, at 200× magnification;

FIG. 27 is a photomicrograph of the centre of billet 1 parallel to the extrusion axis, after solution heat treatment, at 100× magnification;

FIG. 28 is a photomicrograph of the centre of billet 1 parallel to the extrusion axis, after solution heat treatment, at 200× magnification;

FIG. 29 is a photomicrograph of the centre of billet 2 parallel to the extrusion axis, after solution heat treatment, at 100× magnification;

FIG. 30 is a photomicrograph of the centre of billet 2 parallel to the extrusion axis, after solution heat treatment, at 200× magnification;

Grain Size Determination

| As Extruded Billets | |
|---|---|
| Billet 1 Outside Edge | 10.2 microns |
| Billet 1 Centre | 7.6 microns |
| Billet 2 Outside Edge | 7.6 microns |
| Billet 2 Centre | 7.6 microns |
| (Structure is quite broken up with very large and very small grains.) | |
| Solution Heat Treated Billets | |
| Billet 1 Outside Edge | 25.3 microns |
| Billet 1 Centre | 22.5 microns |
| Billet 2 Outside Edge | 22.5 microns |
| Billet 2 Centre | 20.3 microns |
| (Well defined solution heat treated grain structure) | |

DISCUSSION

The microstructure observed consists of magnesium primary magnesium and aluminum solid solution crystals and eutectic consisting of two phases, secondary magnesium solid solution crystals and $Mg_{17}Al_{12}$ intermetallic compound. The structure was quite broken up in the "as cast" specimens and grain size measurement is only approximate.

Recrystallized grain structure in the solution heat treated specimens was more accurate and well defined in the microstructure.

The photomicrographs taken in the direction of the extrusion axis of the "as extruded" specimens showed long stringers in the microstructure. The corresponding photomicrographs taken from the heat treated specimens showed a more evenly distributed recrystallized structure.

The amount of breakdown that the grain structure of the as-cast billet will undergo is likely a function of the amount of reduction. In the present case 7 to 1 reduction was used. Some sources suggest that the optimum degree of reduction should be on the order of from 10:1 to 17:1. In practice however the degree of reduction required may be less if the starting alloy is relatively fine grained.

EXAMPLE 2

OVERVIEW 3 in. diameter ×180 mm long slugs of magnesium alloy AZ61 were tested.

10 of the slugs had been solution heat treated.

SSM casting tests were made using a Buhler SCN66 machine. It was not possible at the time of the trials to store the injection curves due to software issues.

As a test piece, a welding test plate die was chosen, heated by oil to approximately 220° C.

In general, the material was SSM-castable, but different than other magnesium alloys. The thickwall part (10 mm thick) was perhaps not ideal for magnesium casting.

SSM HEATING

Slug heating was performed in a single coil induction heater and optimized such that the slugs were removed from the coil just prior to the onset of burning which corresponded to a softness which allowed dissection with a knife. Total heating time was approximately 230 seconds. Very little metal run-off was obtained during the heating process.

A single stage induction heater was utilized for the test as multi-stage induction heating was not available at the test facility. It is expected that better heating would have been obtained with multi-stage induction heating. Ideally at the end of the heating cycle the billet should have a uniform temperature throughout with a well controlled solid to liquid ratio.

SSM CASTING

The first parts were cast using a plunger velocity of 0.3 to 0.8 meters per second. These conditions barely filled the die and visual laps were apparent at the end of the part.

With a velocity increase to 1.8 m/s (onset of flashing), the parts filled better but lapping was still apparent. The best results were obtained using a plunger velocity of 1.2 m/s.

The heat treated slugs appeared lighter in color after heating and had less tendency to burn. The SSM parts produced from these slugs also appeared lighter in color.

Even at plunge velocities as low as 0.05 m/s and up to above 0.5 m/s, it was not possible to achieve a smooth metal front. In all cases the alloy flowed as individual "glaciers".

Two plates (numbers 34 and 35) which were formed at a plunger velocity of 1.8 m/s were subjected to metallurgical evaluation (see Example 3).

As can be seen, the only parameter varied in making the test plates was the gate or plunger velocity. Accordingly none of the resulting plates could be considered high quality castings. It is expected that much better results would have been obtained if the die temperature had been increased to approximately 300° C. and the slugs were heated in the multi-stage induction heater.

As illustrated by the tests, if the gate speed is too high, the metal flow will not be laminar. Too low a gate speed results in metal solidification before the mold cavity fills.

Despite the less than optimal casting conditions, as illustrated by example 3 below, the cast plates show good physical properties.

The casting machine was a single cylinder unit having servo control to carefully control the force driving the slug into the closed die. Optimally the casting process will cause the outer skin of the slug which contains surface oxides resulting from the heating process to be removed from the virgin metal.

EXAMPLE 3

Plates 34 and 35 were sectioned into six sections as illustrated in FIG. 30. One quarter inch (¼ in.) round samples were removed from the sections and tested for mechanical properties. The plates were not heat treated and the results are tabulated in Table 1 below.

TABLE 1

| PLATE NO. | SAMPLE NO. | SAMPLE TYPE | UTS (ksi) | YS (ksi) | ELONG % |
|---|---|---|---|---|---|
| 34 | 2 | .250" ROUND | 31.5 | 13.9 | 10.9 |
| 34 | 4 | .250" ROUND | 33.2 | 14.2 | 14.1 |
| 34 | 6 | .250" ROUND | 32.9 | 14.5 | 13.6 |
| 35 | 2 | .250" ROUND | 33.6 | 14.7 | 12.3 |
| 35 | 4 | .250" ROUND | 31.1 | 13.9 | 10.3 |
| 35 | 6 | .250" ROUND | 33.3 | 13.9 | 13.3 |

Figure 31:
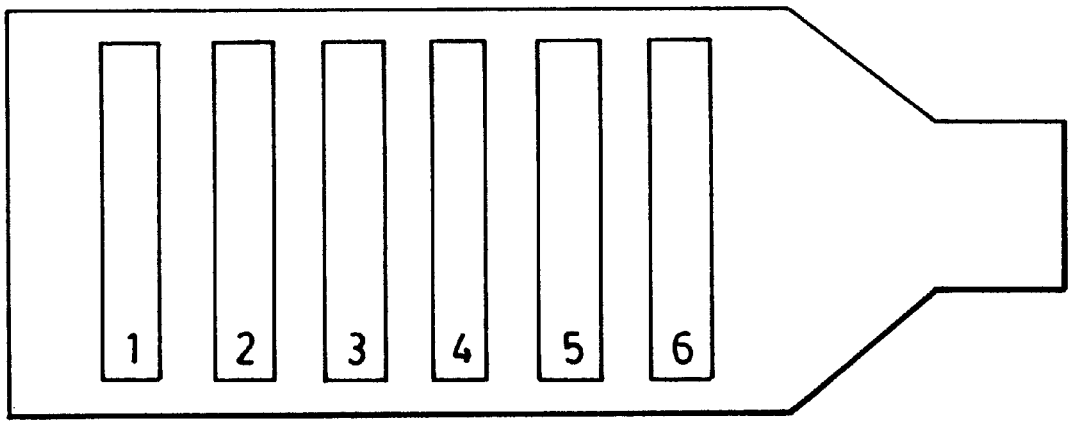
FIG. 31 illustrates sample locations in a test plate which were tested in Example 3.

Plates 34 and 35 were subsequently solution heat treated for 12 hours at 426° C. and still air cooled. One quarter inch (¼ in.) round samples were cut from the plates and the mechanical properties of those samples were tested. The results of the tests are tabulated in Table 2 below. In Table 2 below the sample plan for the heat treated plates is the same as illustrated in FIG. 31.

TABLE 2

| PLATE NO. | SAMPLE NO. | SAMPLE TYPE | UTS (ksi) | YS (ksi) | ELONG % | COMMENTS |
|---|---|---|---|---|---|---|
| 34 | 1 | .250" ROUND | 23.4 | 14.1 | 3.0 | OXIDE INCL. |
| 34 | 3 | .250" ROUND | SAMPLE DAMAGED IN MACHINING | | | |
| 34 | 5 | .250" ROUND | 37.6 | 14.6 | 18.5 | |
| 35 | 1 | .250" ROUND | 37.0 | 12.8 | 15.7 | |
| 35 | 3 | .250" ROUND | 36.9 | 13.8 | 16.4 | |
| 35 | 5 | .250" ROUND | 36.8 | 12.8 | 19.3 | |

Figure 32:
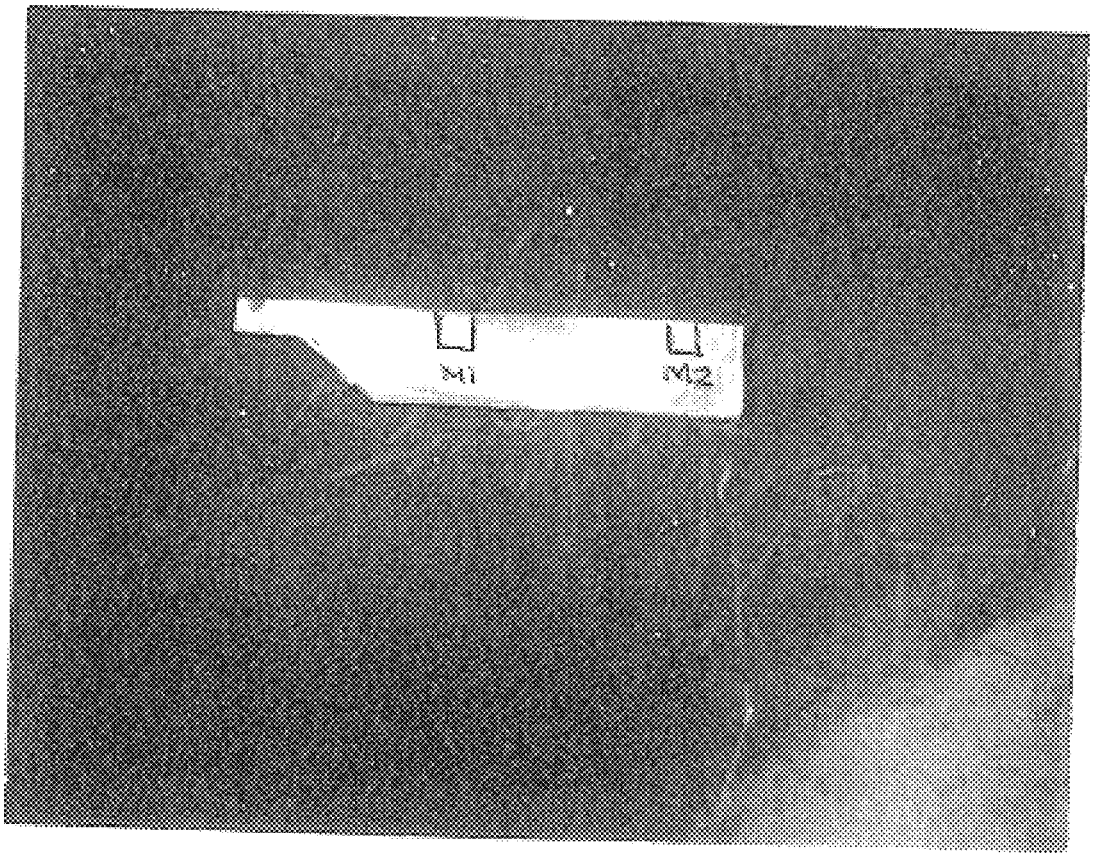
FIG. 32 illustrates the locations at which photomicrographs were taken in Example 3 below.
Figure 33:
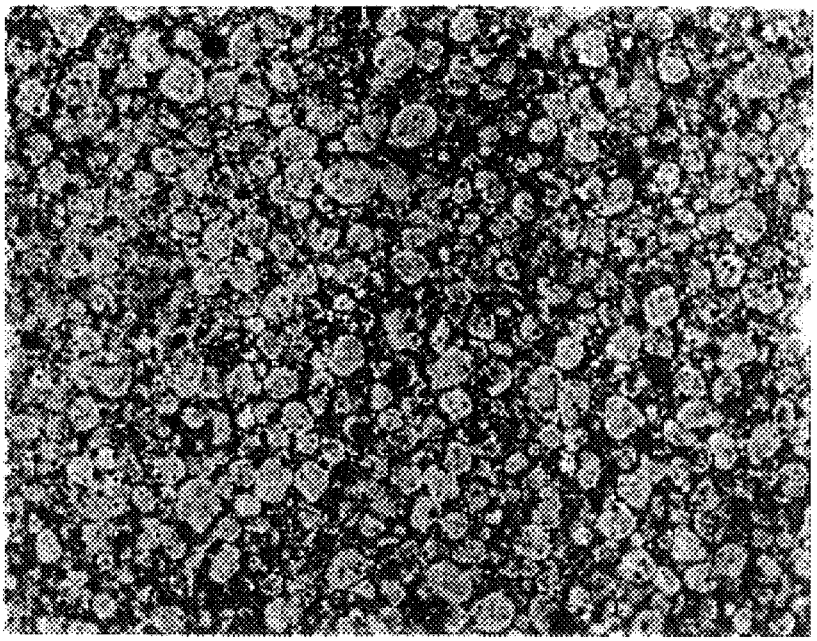
FIGS. 33 through 36 are photomicrographs individually described in Example 3 below.
Figure 34:
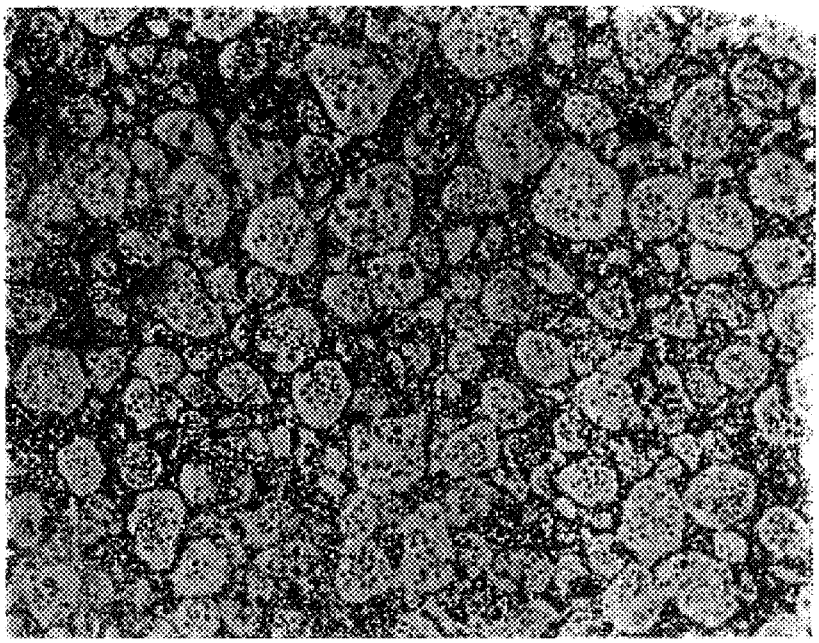
Figure 35:
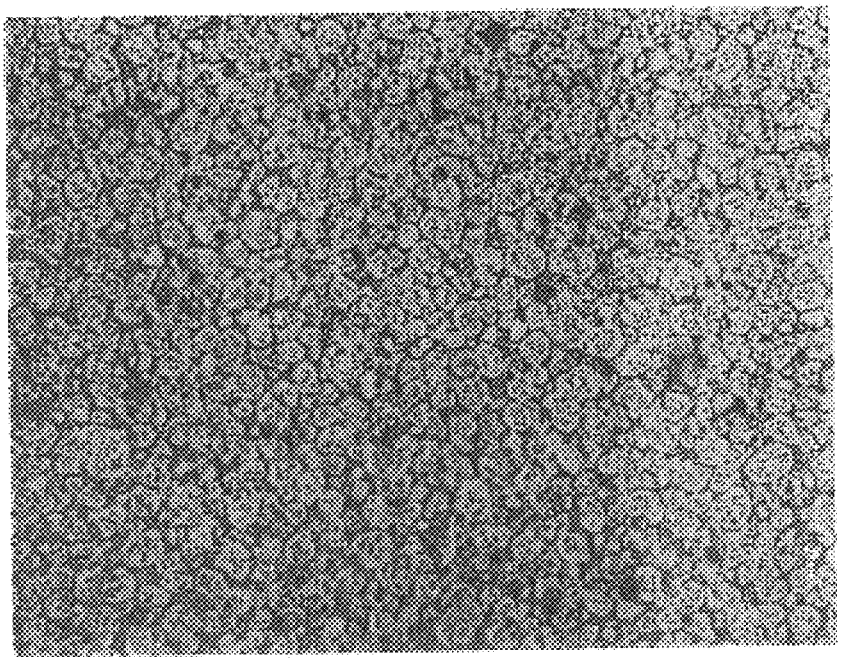
Figure 36:
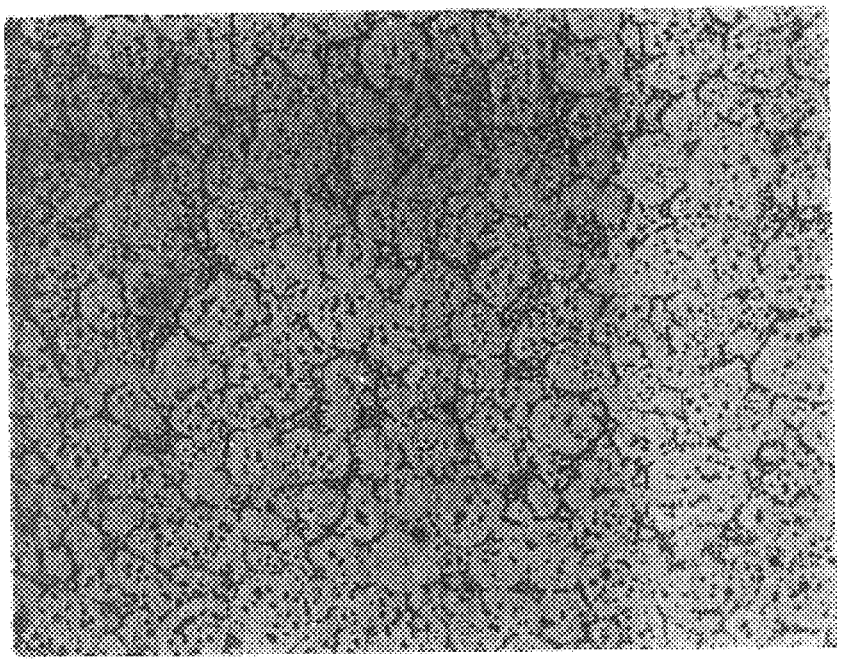

Photomicrographs of one of the plates were taken at locations M1 and M2 as illustrated in FIG. 32. The photomicrographs are reproduced in FIGS. 33 through 36 as follows.:

FIG. 33 is a photomicrograph of sample M1 at 50× magnification;

FIG. 34 is a photomicrograph of sample M1 at 100× magnification;

FIG. 35 is a photomicrograph of sample M2 at 50× magnification;

FIG. 36 is a photomicrograph of sample M2 at 100× magnification.

The above description is intended in an illustrative rather than a restrictive sense. One skilled in the art would recognize that the specific process perameters used in the examples would have to be varied to adapt the present invention to particular alloys, equipment and parts being cast. For example, although AZ61 magesium alloy was utilized in the tests no doubt other magesium alloys could be used. The process can also be adapted to metal systems other than magesium where the metal is capable of forming a two-phase system comprising solid particles in a lower melting matrix. The process will work with aluminum and may also work with other similar metal systems such as copper. It is intended that any such variations be deemed as within the scope of the present patent as long as such are within the spirit and scope of the claims set out below.

Preferably heating of the billet 22 prior to forming should be carried out at a rate of no greater than 30° C. per second and even more preferably at a rate of no greater than 20° C. per second if aluminum is being used. Heating at a rate greater than 30° C. per second may result in the precipitation of silicon from the resulting stresses thereby deleteriously affecting machinability of the finished part. It has been found that a three stage induction heater is particularly well suited to maintaining a desirable heating rate.

The direct chill cast billet tested in Example 1 had a maximum grain size of about 74 microns. It is expected that best results will be obtained with a direct chill cast billet having a maximum grain size of less than 100 microns.

I claim:

1. A semi-solid metal die casting process using a direct chill cast billet consisting of the following steps:

i) heating the direct chill cast billet to a temperature above its recrystallization temperature and below its solidus temperature;

ii) reducing the diameter of the heated billet from step i) and breaking down its grain structure by extruding it through an extruding die at said temperature above its recrystallization temperature and below is solidus temperature to form an extruded column without introducing any strain in addition to that associated with the extruding;

iii) cutting the extruded column into billets;

iv) heating a billet from step iii) to a thixotropic forming temperature;

v) placing the heated billet from step iv) into an injection chamber in a semi-solid die casting machine;

vi) injecting the heated billet into a mold to form a part; and, vii) removing the part from the mold;

wherein the direct chill cast billet used in step i) during its production was cooled at a rate sufficient to produce a grain size of less than 100 microns.

2. A semi-solid metal die casting process as claimed in claim 1 wherein the direct chill cast billet used in step i) has a maximum grain size of from about 25 to about 50 microns.

3. A semi-solid metal forming process as claimed in claim 1 wherein a suitable alloy of aluminum is used and is heated in step iv) in a three stage induction heater at a rate not exceeding 30° C. per second.

4. A semi-solid metal forming process as claimed in claim 3 wherein the heating rate in step iv) does not exceed 20° C. per second.

5. A semi-solid metal forming process as claimed in claim 3 wherein in step iv) the billet is heated to said thixotropic forming temperature at a rate between 20° C. per second and 30° C. per second.

6. A semi-solid metal die casting process as claimed in claim 1 wherein the direct chill cast billet used in step i) was, during its production, cooled at a rate exceeding 2° C. per second.

7. A semi-solid metal forging process using a direct chill cast billet consisting of the following steps:

i) heating the direct chill cast billet to a temperature above its recrystallization temperature and below its solidus temperature;

ii) reducing the diameter of the heated billet from step i) and breaking down its grain structure by extruding it through an extruding die at said temperature above its recrystallization temperature and below its solidus temperature to form an extruded column without introducing any strain in addition to that associated with the extruding;

iii) cutting the extruded column into billets;

iv) heating a billet from step iii) to a thixotropic forming temperature;

v) placing the heated billet from step iv) between a set of dies in a forging machine;

vi) actuating the forging machine to squeeze the billet between the set of dies to form a part; and, vii) separating the dies and removing the part;

wherein the direct chill cast billet used in step i) was cooled at a rate sufficient to produce a maximum grain size of less than 100 microns during its production.

8. A semi-solid forging process as claimed in claim 7 wherein the direct chill cast billet used in step i) has a maximum grain size of from about 25 to about 50 microns.

9. A semi-solid metal die casting process as claimed in claim 7 wherein the direct chill cast billet used in step i) was, during its production, cooled at a rate exceeding 2° C. per second.

10. A process for producing a billet for use in a semi-solid metal forming process consisting of the following steps:

i) heating a direct chill cast billet to a temperature above its recrystallization temperature and below its solidus temperature;

ii) reducing the diameter of the heated billet from step i) and breaking down its grain structure by extruding it through an extruding die at said temperature above its recrystallization temperature and below its solidus temperature to form an extruded column without introducing any strain in addition to that associated with the extruding; and, iii) cutting the extruded column to form said billet;

wherein the direct chill cast billet used in step i) was cooled at a rate sufficient to produce a maximum grain size of less than 100 microns during its production.

11. A billet as claimed in claim 10 wherein the direct chill cast billet used in step i) has a maximum grain size of from about 25 to about 50 microns.

12. A semi-solid metal forming process consisting of the steps of:

i) obtaining a billet according to claim 10;

ii) heating the billet of step i) to a thixotropic forming temperature; and, iii) squeezing the billet from step ii) between the dies of a metal forming die set to form a part.

13. A semi-solid metal forming process consisting of the steps of:

i) obtaining a billet according to claim 11;

ii) heating the billet of step i) to a thixotropic forming temperature; and, iii) squeezing the billet from step ii) between the dies of a metal forming die set to form a part.

14. A semi-solid metal die casting process as claimed in claim 10 wherein the direct chill cast billet used in step i) was, during its production, cooled at a rate exceeding 2° C. per second.

15. A semi-solid metal forming process consisting of the following steps:

i) heating a direct chill cast billet to a temperature above its recrystallization temperature and below its solidus temperature;

ii) extruding at a temperature above its recrystallization temperature and below its solidus temperature, the heated direct chill cast billet from step i) into an extruded column without introducing any strain in addition to that associated with the extruding;

iii) cutting at least one billet from the extruded column;

iv) heating the billet from step iii) to a semi-solid state; and, v) squeezing the billet from step iv) into a cavity in a metal forming die set to form a part; wherein, AZ61 magnesium alloy is used for the direct chill cast billet, the direct chill cast billet is cooled during its production at a rate sufficient to produce a maximum grain size of less than 100 microns, in step i) the cast billet is heated to a temperature of approximately 300° C., the heated chill cast billet is extruded in step ii) at a temperature of from about 330–350° C., and, the heating in step iv) corresponds to a softness which allows dissection with a knife.

16. A semi-solid metal forming process as claimed in claim 15 wherein the direct chill cast billet was cooled during its production at a rate sufficient to produce a grain size of from about 25 to about 50 microns.

17. A semi-solid metal forming process as claimed in claim 16 wherein said direct chill cast billet was cooled during its production at a rate exceeding 2° C. per second.

* * * * *